US005664357A

United States Patent [19]

Kilfitt et al.

[11] Patent Number: 5,664,357

[45] Date of Patent: Sep. 9, 1997

[54] WEAPON BOLT ASSEMBLY HAVING PREMATURE IGNITION-PREVENTING MEANS

[75] Inventors: Dirk Kilfitt, Velbert; Heinz-Peter Hellmeister, Willich; Olaf Kersten; Frank Junker, both of Aachen, all of Germany

[73] Assignee: Rheinmetall Industrie GmbH, Ratingen, Germany

[21] Appl. No.: 623,683

[22] Filed: Mar. 29, 1996

[30] Foreign Application Priority Data

Mar. 29, 1995 [DE] Germany ..... 195 11 578.3

[51] Int. Cl.[6] ..... F41A 19/00

[52] U.S. Cl. ..... 42/69.01; 42/69.02; 89/194

[58] Field of Search ..... 42/69.01, 65, 69.02; 89/194, 195, 196, 197, 198, 199

[56] References Cited

U.S. PATENT DOCUMENTS 4,416,077 11/1983 Thompson ..... 42/25

4,445,292 5/1984 Martin ..... 42/16

4,447,975 5/1984 Ljutie ..... 42/16

5,259,138 11/1993 Scirica ..... 42/70.08

*Primary Examiner*—Charles T. Jordan

*Assistant Examiner*—Meena Chelliah

*Attorney, Agent, or Firm*—Spencer & Frank

[57] ABSTRACT

A weapon bolt assembly includes a bolt portion including a recess; a firing pin unit including a striker plunger axially slidably received in the recess and having an axially measured length and a firing pin attached to the striker plunger. The firing pin unit has a first position in which the firing pin projects from the bolt portion and a second position in which the firing pin is situated in its entirety within the bolt portion. A firing spring is disposed in the recess and has a relaxed state and a stressed state. In the relaxed state of the firing spring and in the first position of the firing pin unit a clearance is defined between the two components. In the stressed state the firing spring exerts a force on the firing pin unit urging it into its first position. The axially measured length of the firing pin unit is such that in the second position the firing spring remains in the relaxed state. An arming mechanism moves the firing pin unit against a force of the firing spring for placing it into the stressed state.

2 Claims, 2 Drawing Sheets

WEAPON BOLT ASSEMBLY HAVING PREMATURE IGNITION-PREVENTING MEANS

CROSS REFERENCE TO RELATED APPLICATION

This applications claims the priority of German Application No. 195 11 578.3 filed Mar. 29, 1995, which is incorporated herein by reference.

BACKGROUND OF THE INVENTION

This invention relates to a weapon bolt assembly including a firing pin unit and an arming (tensioning) device therefor. The firing pin unit is displaceably supported in a part of the weapon bolt and has a striker plunger and a firing pin which is attached to the striker plunger. The arming device includes a firing spring which may be armed to exert a force against the firing pin unit.

Arming devices of the above-outlined type for firing pin units have been used in handheld and shoulder weapons as well as in propellant-driven pin setting devices as disclosed, for example, in German Offenlegungsschrift (application published without examination) 1 703 439 or 1 728 198. In order to arm the striker plunger, the latter is either pressed by a spring into the bolt or is withdrawn against the force of a spring by means of a slide member which engages a detent lug of the striker plunger.

It is a disadvantage of the first-noted alternative according to which a spring shifts the striker plunger into the armed position that the technological outlay is relatively high. As to the second alternative, according to which the striker plunger is tensioned against the force of a spring, the risks are not negligible that in case of a malfunction of the detent lug, the firing pin slides forwardly and prematurely ignites the cartridge during the loading process.

SUMMARY OF THE INVENTION

It is an object of the invention to provide an improved weapon bolt assembly including a firing pin unit and an arming device which is of simple construction and in which an unintentional ignition of the cartridge during the loading process practically cannot occur.

This object and others to become apparent as the specification progresses, are accomplished by the invention, according to which, briefly stated, the weapon bolt assembly includes a bolt portion including a recess; a firing pin unit including a striker plunger axially slidably received in the recess and having an axially measured length; and a firing pin attached to the striker plunger. The firing pin unit has a first position in which the firing pin projects from the bolt portion and a second position in which the firing pin is situated in its entirety within the bolt portion. A firing spring is disposed in the recess and has a relaxed state and a stressed state. In the relaxed state of the firing spring and in the first position of the firing pin unit a clearance is defined between the two components. In the stressed state the firing spring exerts a force on the firing pin unit urging it into its first position. The axially measured length of the firing pin unit is such that in the second position the firing spring remains in the relaxed state. An arming mechanism moves the firing pin unit against a force of the firing spring for placing it into the stressed state.

Thus, it is the basic principle of the invention to select the length of the firing pin unit such that the firing pin, when it becomes fully withdrawn into the bolt, at the most touches the firing spring, so that the latter remains in its relaxed state. As a result of this arrangement, before the cartridge is moved into the operational range of the firing pin unit during the loading operation, the firing pin is withdrawn to such an extent that the tip of the firing pin is within the weapon bolt without arming the firing spring at that time. The spring is tensioned only after the cartridge is securely seated in the chamber.

DESCRIPTION OF THE PREFERRED EMBODIMENT

Figure 1:
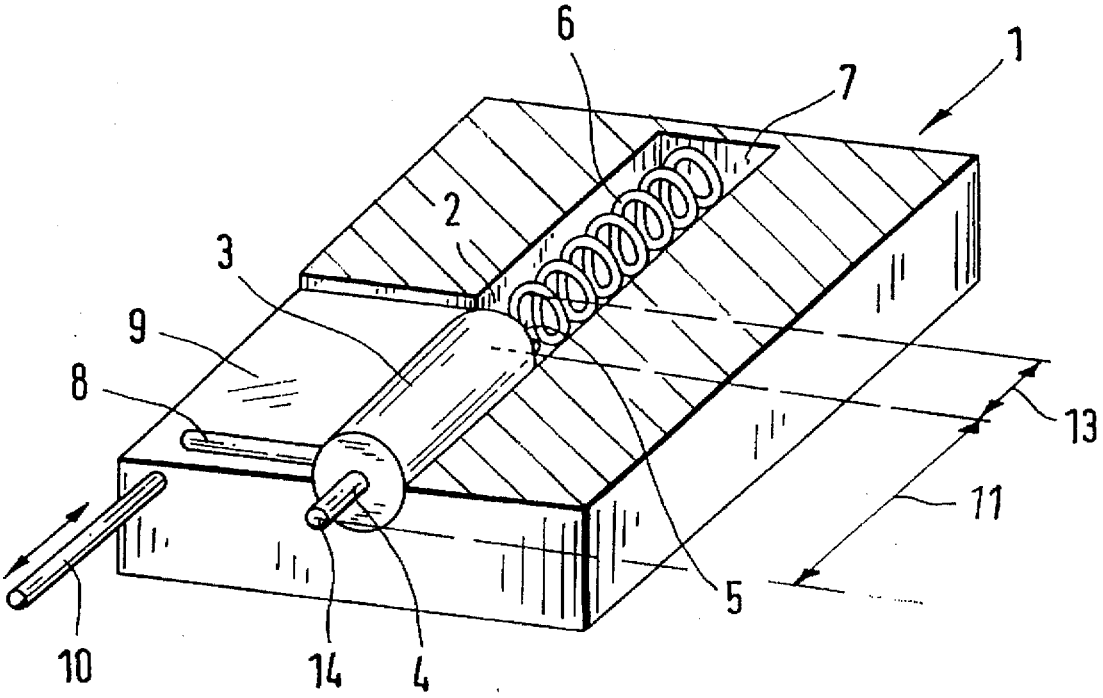
FIG. 1 is a schematic, partially sectional perspective view of a preferred embodiment of the weapon bolt assembly according to the invention.

Turning to FIG. 1, a bolt portion 1 of a weapon is provided with a recess 2 for receiving a longitudinally slidable striker plunger 3 therein. The striker plunger 3 has a firing pin 4 on its end face oriented towards the non-illustrated weapon chamber. The striker plunger 3 and the firing pin 4 together constitute a firing pin unit. The end face 5 of the striker plunger 3 opposite the firing pin 4 is engageable by one end of a firing spring 6 received in the recess 2 of the bolt portion 1. The other end of the firing spring 6, oriented away from the non-illustrated weapon chamber, is counter supported by a face 7 of the bolt portion 1, forming an end wall of the recess 2.

A carrier (detent) lug 8 secured to the striker plunger 3 is guided in a recess 9 of the bolt portion 1 and is engageable by a rod-shaped sliding component 10, forming part of an arming device.

According to the invention the length 11 of the firing pin unit 3, 4 is so selected that if and when the end face 5 of the striker plunger 3 arrives into contact with the spring 6, the firing pin 4 is in its entirety within the bolt portion 1, while the spring 6 remains in its relaxed (untensioned) state.

Figure 2:
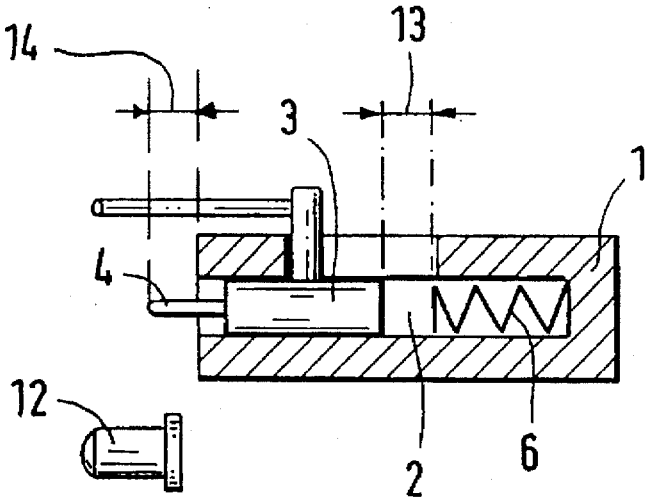
FIG. 2 is a schematic, partially sectional side elevational view of the preferred embodiment, shown in an operational position before loading a cartridge.
Figure 3:
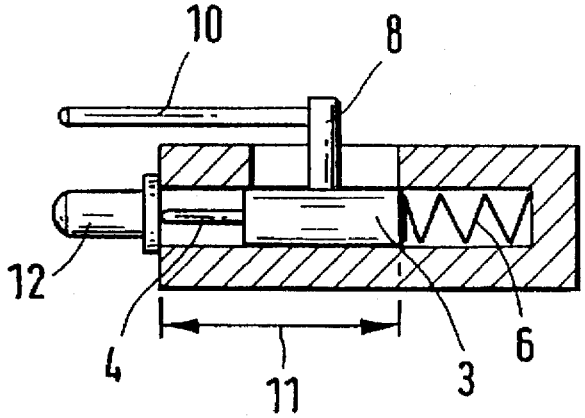
FIG. 3 is a view similar to FIG. 2, showing an operational position after loading the cartridge.
Figure 4:
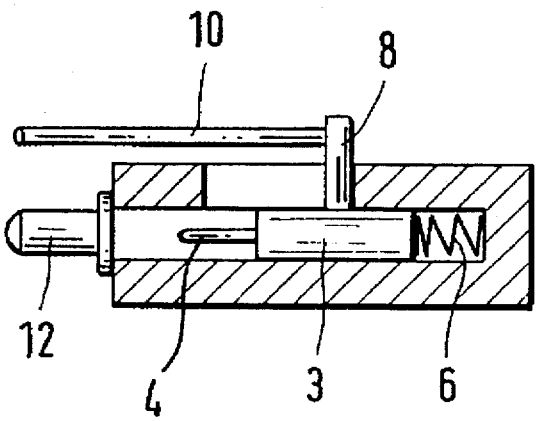
FIG. 4 is a view similar to FIG. 3, showing an operational position after tensioning the firing spring.

In the description which follows, the operation of the weapon bolt assembly according to the invention will be set forth in conjunction with FIGS. 2, 3 and 4.

FIG. 2 illustrates the operational phase after a cartridge was fired and the expended case was ejected. The firing spring 6 is in its relaxed state and the firing pin 4 of the firing pin assembly 3, 4 partially projects from the bolt portion 1 into the weapon chamber. The subsequent cartridge 12 is ready to be loaded. Because of the forward motion of the striker plunger 3 by inertia during the preceding firing process, between the end face 5 of the striker plunger 3 and the adjacent end of the firing spring 6 a predetermined distance 13 prevails which should be at least as large as the distance 14 by which the firing pin 4 projects from the bolt portion 1. By virtue of this arrangement the striker plunger 3 can contact the relaxed firing spring 6 only when the firing pin 4 no longer projects from the recess 2 into the weapon chamber.

FIG. 3 shows the operational position in which the cartridge 12 has been loaded into the weapon chamber after the striker plunger 3 was, by the slide 10 in contact with the carrier lug 8, withdrawn to such an extent that the firing pin 4 has been moved back to lie in its entirety in the recess 2 while, at the same time, the striker plunger 3 at the most touches the relaxed firing spring 6, that is, the spring 6 will not yet be tensioned.

Turning to FIG. 4, by means of a further axial displacement of the slide member 10, the firing pin assembly 3, 4 is further withdrawn, as a result of which the firing spring 6 is compressed (armed). For the successive firing process the slide 10 is released, freeing the firing pin assembly to move forward, urged by the firing spring 6.

It will be understood that the above description of the present invention is susceptible to various modifications, changes and adaptations, and the same are intended to be comprehended within the meaning and range of equivalents of the appended claims.

What is claimed is:

1. A weapon bolt assembly comprising (a) a bolt portion including a recess;

(b) a firing pin unit including (1) a striker plunger axially slidably received in said recess and having an axially measured length; and (2) a firing pin attached to said striker plunger; said firing pin unit having a first position in which said firing pin projects from said bolt portion and a second position in which said firing pin is situated in its entirety within said bolt portion;

(c) a firing spring disposed in said recess; said firing spring having a relaxed state and a stressed state; in said relaxed state of said firing spring and in said first position of said firing pin unit a clearance is defined between said firing pin unit and said firing spring; in said stressed state of said firing spring said firing spring exerts a force on said firing pin unit urging said firing pin unit into said first position thereof; said axially measured length of said firing pin unit being such that in said second position of said firing pin unit said firing spring remains in said relaxed state; and (d) arming means for moving said firing pin unit against a force of said firing spring for placing said firing spring into said stressed state.

2. The weapon bolt assembly as defined in claim 1, further comprising (e) an additional recess provided in said bolt portion;

(f) a carrier lug affixed to said firing pin unit and movable therewith in said additional recess; and (g) a slide member constituting said arming means and cooperating with said carrier lug.

* * * * *